US006653984B2

(12) United States Patent
Park et al.

(10) Patent No.: US 6,653,984 B2
(45) Date of Patent: Nov. 25, 2003

(54) ELECTRONICALLY SCANNED DIELECTRIC COVERED CONTINUOUS SLOT ANTENNA CONFORMAL TO THE CONE FOR DUAL MODE SEEKER

(75) Inventors: Pyong K. Park, Tucson, AZ (US); Ralston S. Robertson, Northridge, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/115,391

(22) Filed: Apr. 3, 2002

(65) Prior Publication Data

US 2003/0043085 A1 Mar. 6, 2003

Related U.S. Application Data

(60) Provisional application No. 60/281,747, filed on Apr. 5, 2001.

(51) Int. Cl.[7] ..... H01Q 13/10

(52) U.S. Cl. ..... 343/770; 343/771

(58) Field of Search ..... 343/770, 781 CA, 343/720, 771, 774, 772, 776; 342/53

(56) References Cited

U.S. PATENT DOCUMENTS 5,307,077 A * 4/1994 Branigan et al. ..... 343/720
5,650,793 A * 7/1997 Park ..... 343/771
6,150,991 A * 11/2000 Hulderman ..... 343/781 CA
6,429,825 B1 * 8/2002 Martek ..... 343/770

* cited by examiner

*Primary Examiner*—James Clinger
(74) *Attorney, Agent, or Firm*—Renner, Otto, Boisselle & Sklar

(57) ABSTRACT

A dielectric covered continuous slot (DCCS) antenna operable at RF frequencies. The antenna includes a conical or cylindrical dielectric radome structure having a nominal thickness equal to one quarter wavelength at a frequency of operation of the antenna. A conductive layer is defined on a contour surface of the radome structure, with a plurality of continuous slots defined in the conductive layer. The slots extend circumferentially about the longitudinal axis of the antenna and are spaced apart in a longitudinal sense. A serpentine end-fed signal transmission structure is disposed within the radome structure for carrying RF feed signals from an excitation end of the structure to a second end of the transmission structure. The slots are disposed along the serpentine transmission structure such that energy leaks from the transmission structure through the slots and the radome structure, forming a beam which is scannable in a direction along the longitudinal antenna axis by scanning the transmit signal frequency. Due to the frequency dispersive effective electrical length of the transmission structure, the slot spacing effectively changes as the frequency is scanned, thereby scanning the beam. The antenna provides room for an IR (infrared) seeker in the nose of the cone, without blocking the view of the conical/cylindrical antenna.

16 Claims, 3 Drawing Sheets

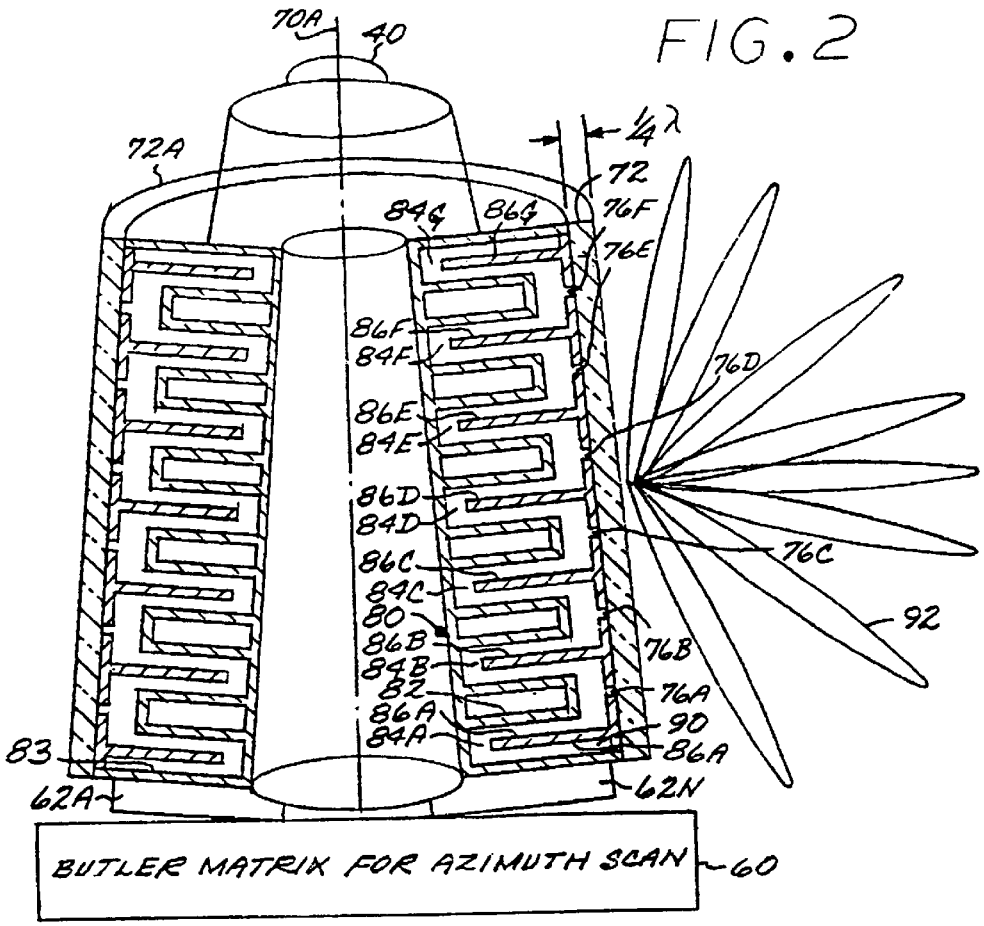
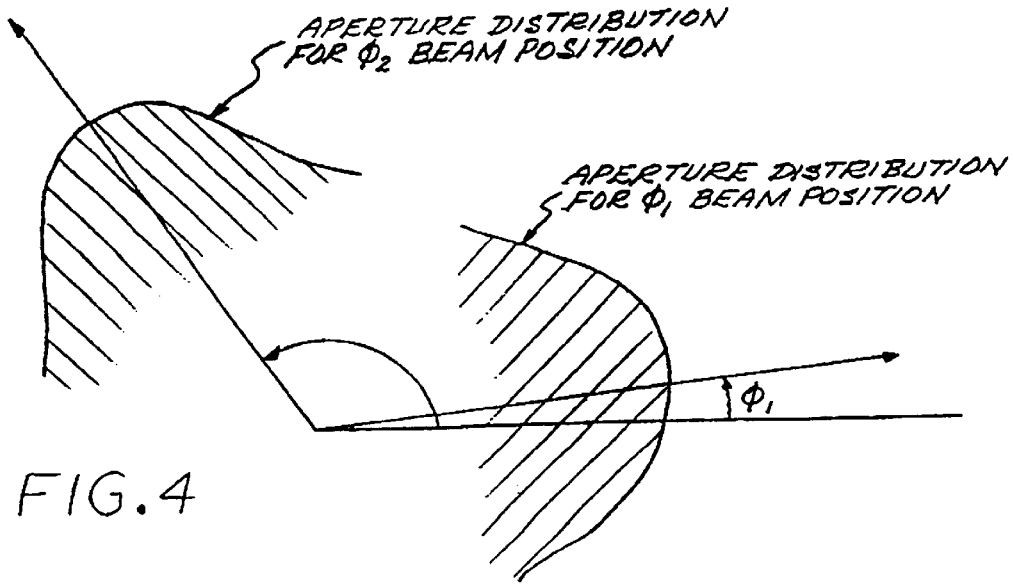
FIG. 4

ELECTRONICALLY SCANNED DIELECTRIC COVERED CONTINUOUS SLOT ANTENNA CONFORMAL TO THE CONE FOR DUAL MODE SEEKER

RELATED APPLICATION

This application claims priority under 35 U.S.C. §119(e) to U.S. Provisional Patent Application Serial No. 60/281,747 filed Apr. 5, 2001. The entire disclosure of the above identified provisional application is hereby incorporated by this reference.

TECHNICAL FIELD OF THE INVENTION

This invention relates to electronically scanned antennas, and more particularly to a conformal dielectric covered continuous antenna useful in guided missiles with an infrared seeker located in the missile cone.

BACKGROUND OF THE INVENTION

In one type of guided missile, a twist Cassegrain reflector antenna on gimbals is used for the RF seeker, with an IR seeker at the nose tip of the radome. The diameter of the IR seeker tends to block some of the view of the RF seeker antenna. It would therefore be an advantage to provide an antenna system with improved RF seeker performance.

One possible solution could be to use a "bug eye" IR seeker in order to remove the blockage problem. However, in order to see everywhere with the bug eye IR seeker, the missile would have to roll. It would further be advantageous to provide an antenna system with improved RF seeker performance and which eliminates the blockage without rolling the missile.

SUMMARY OF THE INVENTION

A dielectric covered continuous slot (DCCS) antenna operable at RF frequencies is described, in accordance with one aspect of the invention. The antenna includes a conical or cylindrical dielectric radome structure having a nominal thickness equal to one quarter wavelength at a frequency of operation of the antenna. A conductive layer is defined on a contour surface of the radome structure, with a plurality of continuous slots defined in the conductive layer. The slots extend circumferentially about the longitudinal axis of the antenna and are spaced apart in a longitudinal sense. A serpentine end-fed signal transmission structure is disposed within the radome structure for carrying RF feed signals from an excitation end of the structure to a second end of the transmission structure. The slots are disposed along the serpentine transmission structure such that energy leaks from the transmission structure through the slots and the radome structure, forming a beam which is scannable in a direction along the longitudinal antenna axis by scanning the transmit signal frequency. Due to the frequency dispersive effective electrical length of the transmission structure, the slot spacing effectively changes as the frequency is scanned, thereby scanning the beam.

This antenna provides room for an IR (infrared) seeker in the nose of the cone, without blocking the view of the conical/cylindrical antenna.

The dielectric cover of the DCCS antenna has a thickness of about one quarter wavelength, reducing the radiation from each slot to such a small amount that several slots can be cascaded as an efficient frequency scanned travelling wave antenna.

BRIEF DESCRIPTION OF THE DRAWING

These and other features and advantages of the present invention will become more apparent from the following detailed description of an exemplary embodiment thereof, as illustrated in the accompanying drawings, in which:

FIG. 2 is a cross-sectional diagrammatic view of the antenna of the system shown in FIG. 1.

FIG. 4 is an exemplary azimuth distribution for an exemplary azimuth scan position.

DETAILED DESCRIPTION OF THE PREFERRED EMBODIMENT

Figure 1:
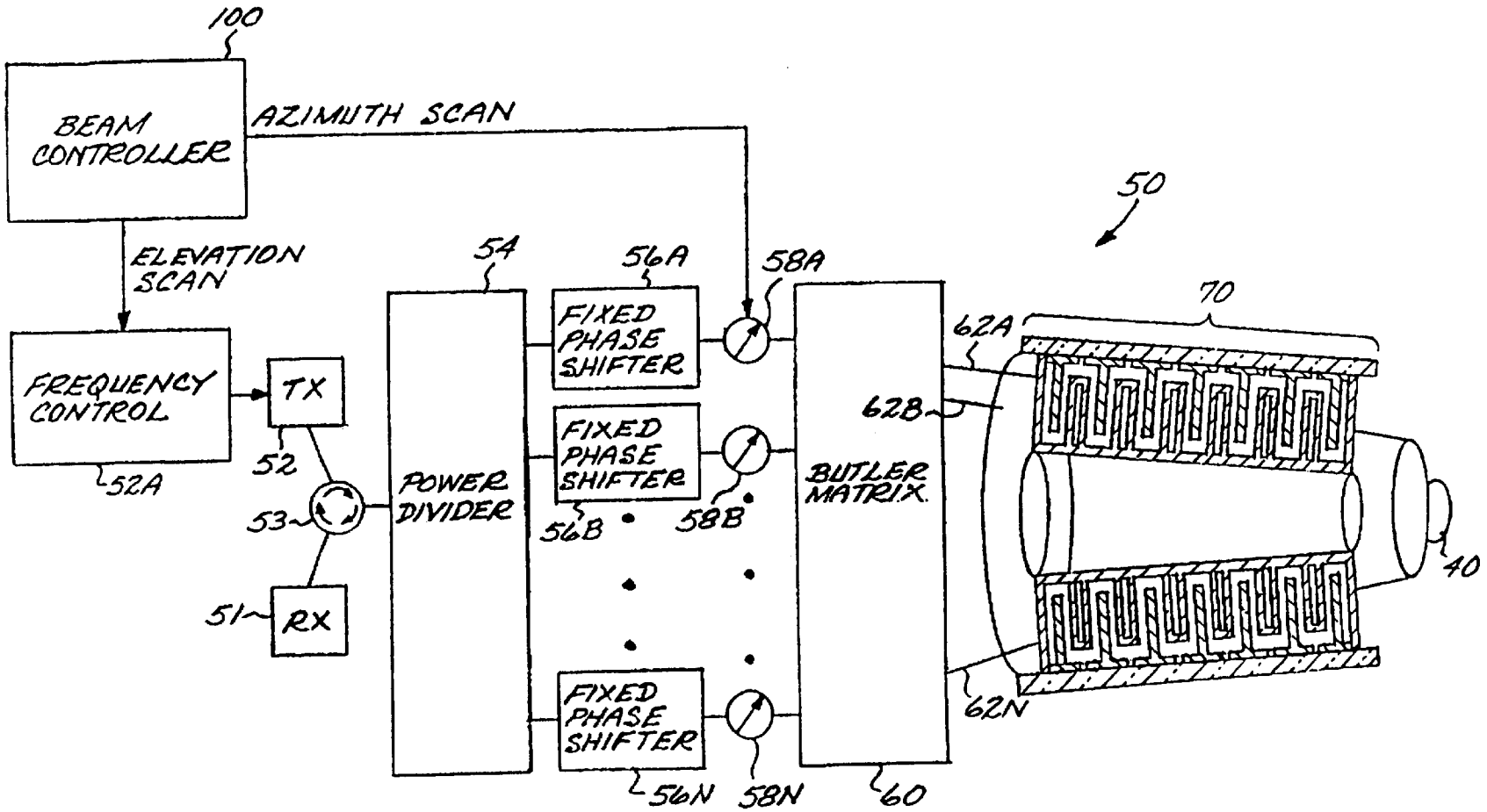
FIG. 1 is a simplified schematic diagram of an electronically scanned antenna system including a dielectric covered continuous slot antenna in accordance with the invention.

In accordance with this invention, an electronically scanned dielectric covered continuous slot ("DCCS") antenna conformal to a radome cone (or a cylinder) is employed, as illustrated in FIG. 1. This antenna provides room for an IR (infrared) seeker in the nose of the cone. Thus, the system of FIG. 1 accommodates the IR seeker 40 located at the nose of the cone, without blocking the view of the conical/cylindrical antenna 70, and can be used for a dual mode (IR & RF) seeker, e.g. in an airborne missile. In this exemplary embodiment, the RF seeker uses the sequential lobbing approach for target detection.

Most dual mode seeker (IR & RF) arrangements have the blockage problem, namely, the IR seeker blocks the view of the RF seeker. Therefore, the RF seeker antenna pattern performance degrades severely. This invention removes the blockage problem.

FIG. 1 is a simplified schematic diagram of an electronically scanned antenna system 50, which includes a transmit oscillator 52 for generating the transmit signals to be radiated through the antenna 70, and a receiver 51. The system 50 may be installed in the body of an airborne missile. The signals generated by the oscillator 52 in a transmit mode are passed through a circulator 53 to the 1:N power divider/combiner 54, which divides the input transmit signal into N signal components. In a receive mode, the divider/combiner 54 combines the energy received at the N output ports, and this combined signal is passed through the circulator 53 to the receiver 51.

The system 50 further includes N fixed phase shifters 56A–56N, N variable phase shifters 58A–58N, and an N×N Butler matrix 60. A beam controller 100 provides respective azimuth scan and elevation scan signals to the variable phase shifters 58A–58N and the frequency control 52A for the transmit oscillator 52.

Figure 3B:
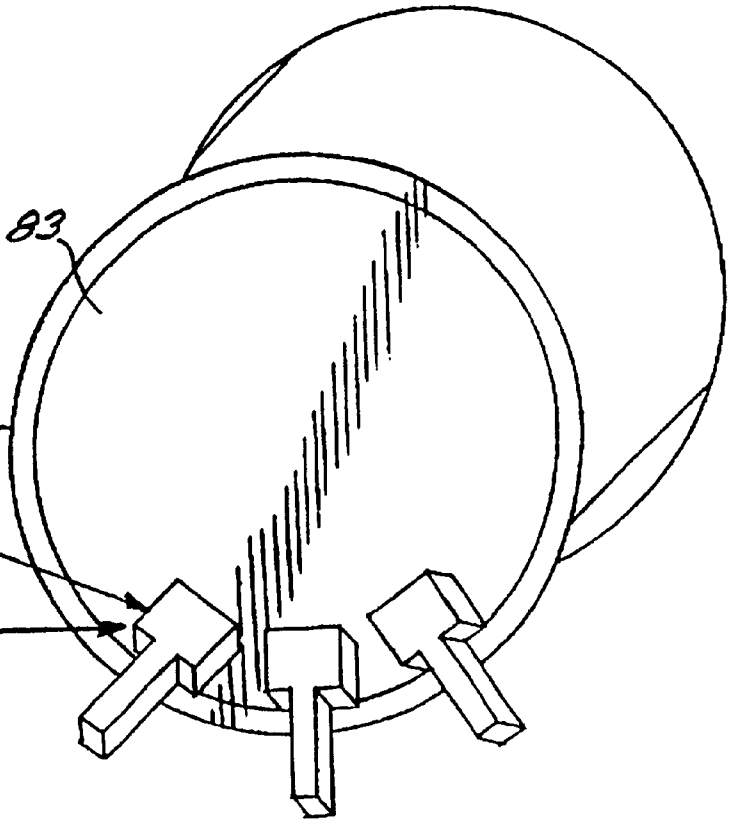
FIG. 3B is a simplified end view of the antenna showing the relative disposition of a plurality of the launchers of FIG. 3A.
Figure 3A:
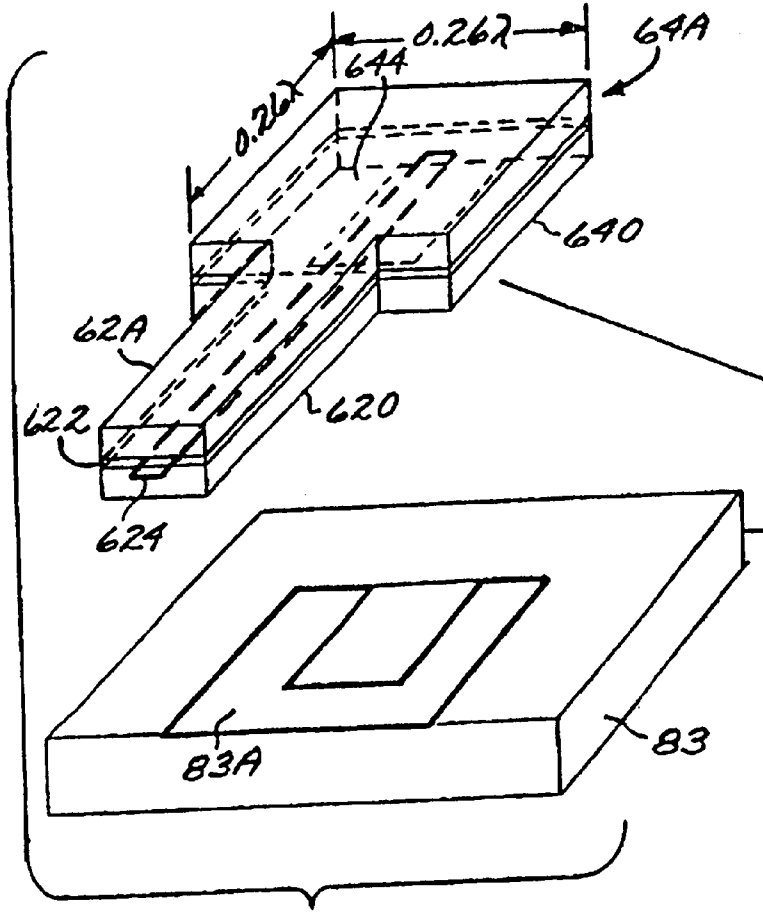
FIG. 3A is an exploded view showing an exemplary launcher for coupling energy into/from the parallel plate structure of FIG. 2.

The DCCS antenna 70 is illustrated in further detail in FIGS. 2 and 3A–3B. In accordance with the invention, the antenna 70 is a conformal DCCS antenna, useful in a missile embodiment as an RF seeker antenna. The antenna 70 is shown in the simplified cross-sectional view in FIG. 2, and includes a dielectric radome 72 in the form of a cone or cylinder. The radome is formed of a dielectric material having a relative dielectric constant $e_r$ in the range of 3–10, and in an exemplary embodiment is a ceramic having a relative dielectric constant of about 5. The radome, when the system is installed in a missile, will serve as the missile radome. A conventional dielectric radome has an effective electrical thickness of ½ wavelength at the center operating frequency, to maximize transmission of RF energy from the radiating elements located inside the radome to the exterior of the radome. In accordance with an aspect of this invention, the radome 72 has an effective electrical thickness of ¼ wavelength at a design frequency of operation. With such a radome thickness, most of the RF energy incident on the radome will be reflected.

The antenna 70 further includes a conductive layer 74 formed on the interior surface 72A of the dielectric radome. Defined in the layer 74 are a series of annular slots; FIG. 2 shows exemplary slots 76A–76F. The actual number of slots is dependent on the application and length of the cone/cylinder. Conforming to the contour of the radome 72 is a corrugated waveguiding structure indicated generally as 80, which defines a series of bounded parallel plate waveguiding areas, arranged in a serpentine and extending longitudinally along the cone/cylinder. The waveguiding structure 80 includes a serpentine conductive structure 82 formed in a series of connected U-shaped bends to define a serpentine conductive surface 82A which forms a series of parallel plate channels 84A–84G. Bisecting each channel is a conductive wall 86A–86G, which extends inwardly from the conductive layer 74 formed on the interior surface of the radome, with its inward edge spaced from the structure 82. The structure 82, conductive layer 74 and the wall members 86A–86G cooperate to define a serpentine RF signal conducting parallel plate path indicated as 90 in FIG. 3. The height of the parallel plate path is similar to that of a waveguide for propagating the frequency band of operation, typically between 0.2 λ to 0.3 λ. Thus, for example, for X-band operation, an exemplary height of the parallel plate path is 0.223 λ.

The slots have a nominal slot spacing selected to provide, in an exemplary application, a 180 degree phase differential of signals arriving at adjacent slots. The serpentine signal feed path allows the slot spacing as viewed on the radome surface to be reduced. Moreover, while the electrical path length from slot to slot is 180 degrees at a design frequency, say the center frequency to produce a broadside beam, this electrical path length is frequency dependent, and will change as the frequency of the transmit oscillator 52 is changed. The width of each slot is somewhat application specific, since by increasing the slot width, the amount of radiation is also increased. Typically, the slot width will be in the range of 1/10 λ to 1/30 λ. In an exemplary X-band antenna application, the slot width is about 0.1 inch.

It will be appreciated that FIG. 2 is a cross-sectional diagrammatic depiction, and thus that the structure 82, layer 74 and wall members 86A–86G are three-dimensional structures. The wall members are annular members with a circular outer periphery. The structure 82 is a corrugated structure. The layer 74 is defined about the inner periphery of the conical or cylindrical radome 72. The path 90 is shown as a cross-sectional cut of a waveguided space between parallel plates, defined by rotating the phantom line 90 about the longitudinal axis 70A of the antenna. In accordance with an aspect of the invention, the waveguided space is air space. This facilitates matching the antenna to free space. While the space could be filled with a dielectric material having a high dielectric constant to increase the effective electrical length of the antenna structure, this would complicate the matching since the dielectric constant of the fill material will be quite different than that of free space.

RF energy is launched into the waveguided space shown as 90 in FIG. 2 by a series of RF launchers 64A–64N, illustrated in FIGS. 3A–3B, which are connected by a series of transmission lines 62A–62N, such as suspended air striplines, coaxial cables, microstrip lines or waveguides, from corresponding input/output ports of the Butler matrix 60. Typically, the electrical lengths of the transmission lines will be equal. Lines 62A and 62N are shown in FIG. 2.

FIG. 3A shows in exploded view an exemplary launcher 64A and a fragmentary portion of the conductive end plate 83 comprising the serpentine structure 82. In this embodiment, the transmission lines 62A–62N are suspended air striplines, disposed within conductive housings. Thus, shown in FIG. 3A is a portion of transmission line 62A, which terminates in a launcher 64A. The line 62A includes conductive housing 620, suspended dielectric substrate 622 and stripline conductor 624 formed on the substrate. The line 62A terminates in a conductive cavity 640, through which the dielectric substrate and stripline conductor extend. [is an opening formed in the conductive housing of the cavity/stripline housing adjacent the slot?] The end plate has formed therein a plurality of U-shaped slot openings, including U-shaped slot 83A. Energy is coupled between the launcher 64A and the parallel plate structure 80 via the slot 83A. Other types of launchers can alternatively be employed.

Typically, the launchers will be equally spaced about the annular peripheral edge 70B of the cone or cylinder of the antenna, with an angular spacing of 360/N degrees, where N is the number of launchers. This is generally illustrated in FIG. 3B.

The antenna forms a beam by the leakage of energy from each slot 76A–76F in the parallel plate serpentine structure 80. This is illustrated in FIG. 2, wherein a plurality of energy patterns 92 are shown, each pattern corresponding to a different elevation scan angle. The superposition of radiated energy from each slot forms a given antenna beam.

The azimuth scan around the cylinder is done by the well known technique of the Butler matrix and a set of variable phase shifters, as described in "A Matrix-Fed Circular Array for Continuous Scanning," B. Sheleg, Proc. IEEE, Vol. 56, No. 11, November 1968. In this exemplary embodiment, each input port of the Butler matrix 60 represents a different circular mode on a cylinder. The input and output of the Butler matrix 60 are the discrete Fourier transform pair. Simple superposition of these circular modes provides a desired aperture distribution for an azimuth scan position shown in FIG. 4. The aperture distribution in FIG. 4 indicates that all the energy is distributed only in the radiation direction. By assigning a new set of phases with the variable phase shifters 58A–58N, the same aperture distribution may be freely rotated around the cylinder.

The elevation beam scan can be achieved by scanning the frequency of the transmit oscillator This changes the electrical path length between adjacent slots. Thus, the antenna beam can be scanned in azimuth and elevation under control of the beam controller 100, which controls the variable phase shifters 58A–58N and the frequency 102 which sets the frequency of the transmitter 52.

It will be appreciated that the antenna system is reciprocal in operation, so that both transmit and receive modes are supported by the hardware.

The electronically scanned, dielectric-covered, continuous slot antenna 70 can replace the conventional mechanical gimbal system. The overall antenna gain will improve because the cylinder surface area is much larger than the area of the circle available for the mechanical scan. More antenna gain is available with the increased surface area offered by this conformal approach than by a flat plate configuration. The number of phase shifters in this invention is much less than the fully populated conventional phased array.

This invention can be configured for the conventional high power transmitter with the power distribution network or for the active phased array with the TR (Transmit/Receive) modules.

Low sidelobe antenna patterns can easily be achieved with the Butler matrix with the variable phase shifters. This invention is also good for a point to a point communication between two moving objects.

The antenna system can advantageously be employed in applications with frequency bands ranging from S band to Ka band, and will typically have a 30% bandwidth, due to frequency bandwidth limitations of the hardware comprising the power divider/combiner.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A dielectric covered continuous slot antenna operable at RF frequencies, comprising:

a conical or cylindrical dielectric radome structure, having a nominal thickness equal to one quarter wavelength at a frequency of operation of the antenna;

a conductive layer defined on a contour surface of the radome structure;

a plurality of continuous slots defined in said conductive layer, the slots extending radially about the longitudinal axis of the antenna and spaced apart in a longitudinal sense; and a serpentine signal transmission structure extending radially inwardly and outwardly about the longitudinal axis within said radome structure for carrying RF feed signals from an excitation end of the structure to a second end of the transmission structure, and wherein said slots are disposed along the serpentine transmission structure such that energy leaks from the transmission structure through said slots and the radome structure.

2. The antenna of claim 1 wherein said transmission structure has an effective electrical path length between adjacent slots which is equivalent to one half wavelength at said frequency of operation.

3. The antenna of claim 1 further including a feed system for feeding antenna feed signals to said transmission structure, said feed system including a transmit oscillator for generating a transmit signal, a power divider for dividing the transmit signal into N transmit signal components, an N×N Butler matrix having N input ports coupled to receive the N transmit signal components and N output ports, N launchers disposed to launch N RF signals into the serpentine structure, and N transmission lines coupling the N output ports and corresponding ones of the N launchers.

4. The antenna of claim 3 further including a frequency control for controlling the frequency of the transmit oscillator and for scanning said frequency over a given range to thereby scan an antenna beam in an elevation direction.

5. The antenna system of claim 3 further comprising N variable phase shifters coupled in signal paths between the power divider and the N input ports of the Butler matrix, and a beam controller for generating phase shift control signals which are coupled to the respective variable phase shifters to control the phase shift of the phase shifters for scanning a beam formed by said antenna in an azimuth direction.

6. The antenna of claim 1 wherein said radome structure is fabricated of a dielectric material having a relative dielectric constant in the range from about 3 to about 7.

7. The antenna of claim 1 wherein said conductive layer is defined on an interior contour surface of the radome structure.

8. A dual mode seeker system, comprising:

an RF seeker including a dielectric covered continuous slot antenna operable at RF frequencies, the antenna including a conical or cylindrical dielectric radome structure, having a nominal thickness equal to one quarter wavelength at a frequency of operation of the antenna, a conductive layer defined on a contour surface of the radome structure, a plurality of continuous slots defined in said conductive layer, the slots extending radially about the longitudinal axis of the antenna and spaced apart in a longitudinal sense, and a serpentine signal transmission structure extending radially inwardly and outwardly about the longitudinal axis within said radome structure for carrying RF feed signals from an excitation end of the structure to a second end of the transmission structure, and wherein said slots are disposed along the serpentine transmission structure such that energy leaks from the transmission structure through said slots and the radome structure; and an infrared seeker located on the longitudinal axis of said antenna adjacent said antenna, wherein said infrared seeker does not block the view of the RF seeker.

9. The system of claim 8 further characterized in that the dual mode seeker system is installed in an airborne missile, and said infrared seeker is located in the nose of the missile.

10. The system of claim 9 wherein said dielectric covered continuous slot antenna is conformal to the body of the missile, said radome forming a part of the missile body.

11. The system of claim 8 wherein said transmission structure has an effective electrical path length between adjacent slots which is equivalent to one half wavelength at said frequency of operation.

12. The system of claim 8 further including a feed system for feeding antenna feed signals to said transmission structure, said feed system including a transmit oscillator for generating a transmit signal, a power divider for dividing the transmit signal into N transmit signal components, an N×N Butler matrix having N input ports coupled to receive the N transmit signal components and N output ports, N launchers disposed to launch N RF signals into the serpentine structure, and N transmission lines coupling the N output ports and corresponding ones of the N launchers.

13. The system of claim 12 further including a frequency control for controlling the frequency of the transmit oscillator and for scanning said frequency over a given range to thereby scan an antenna beam in an elevation direction.

14. The system of claim 12 further comprising N variable phase shifters coupled in signal paths between the power divider and the N input ports of the Butler matrix, and a beam controller for generating phase shift control signals which are coupled to the respective variable phase shifters to control the phase shift of the phase shifters for scanning a beam formed by said antenna in an azimuth direction.

15. The system of claim 8 wherein said radome structure is fabricated of a dielectric material having a relative dielectric constant in the range from about 3 to about 7.

16. The system of claim 8 wherein said conductive layer is defined on an interior contour surface of the radome structure.

* * * * *